United States Patent [19]

Maurizi et al.

[11] Patent Number: 4,841,635

[45] Date of Patent: Jun. 27, 1989

[54] SHAVING DEVICE

[75] Inventors: Ennio S. Maurizi, Port Washington, N.Y.; Joannis A. Loizou, Union, N.J.

[73] Assignee: Maurizi & Loizou Inc., Union, N.J.

[21] Appl. No.: 187,594

[22] Filed: Apr. 28, 1988

[51] Int. Cl.[4] ..... B26B 19/44

[52] U.S. Cl. ..... 30/41; 30/47; 30/86

[58] Field of Search ..... 30/32, 41, 47, 90, 86; 132/80 R

[56] References Cited

U.S. PATENT DOCUMENTS

| | | | |
|---|---|---|---|
| 917,589 | 4/1909 | Grabhorn | 30/47 |
| 1,878,269 | 9/1932 | Deutsch | 30/47 |
| 1,892,836 | 1/1933 | Harvey | 30/41 |
| 3,703,765 | 11/1972 | Perez | 30/41 |
| 4,542,828 | 9/1985 | Gotto | 30/41 |

*Primary Examiner*—Douglas D. Watts

*Attorney, Agent, or Firm*—Morgan & Finnegan

[57] ABSTRACT

The shaving device has a razor head and blade, a reloadable shaving gel chamber, connector connecting the razor head to the device shaft, a plunger which operates to force stored gel through an opening located below the razor head and connector, and a plunger cap which conveniently operates to slide plunger toward the front segment of the shaft.

3 Claims, 3 Drawing Sheets

SHAVING DEVICE

FIELD OF THE INVENTION

This invention relates to the field of shaving devices, and in particular to disposable shaving devices.

BACKGROUND OF THE INVENTION

The evolution of shaving device design has brought increased convenience, improved safety and superior shaving quality to the shaving device consumer. The United States patents described below pertain to shaving device design.

Grabhorn, U.S. Pat. No. 917,589, describes a pocket safety-razor which may be folded into a small space when razor not in use.

Clarke, U.S. Pat. No. 2,325,662, describes a double edge blade razor with a safety guard means and detachable handle.

Bennett, U.S. Pat. No. 2,575,539, describes a razor having a retractable handle, the razor being characterized by its compactness when not in use.

Wang, U.S. Pat. No. 2,818,872, describes a disposable shaving kit which houses a razor, razor handle, razor blade, a container filled with talcum powder, a container filled with shaving cream and a container filled with after-shaving lotion.

Zeles, U.S. Pat. No. 3,349,484, describes a folding safety razor, including a handle portion which carries a soap dispenser, a folding razor head and a removable cap. The dispenser is removably mounted in the handle.

Perez, U.S. Pat. No. 3,703,765, describes a disposable razor which has a blade secured to a fixed razor head and a quantity of shaving cream in the razor handle to be dispensed during one-time use through an aperture in the head of the razor. A paper tab is attached to the surface surrounding the aperture for sealing the aperture when the handle is filled and the razor is not in use.

Roberts, U.S. Pat. No. 4,074,428, describes a pocket razor and shave cream dispenser, wherein one end of a housing is a adapted for removably receiving a handle of a razor, and wherein an internal chamber separate from the razor is provided in the housing for receiving a supply of shave cream.

Wratschko, U.S. Pat. No. 4,332,321, describes a shaving kit which can be carried in a safe stored position, wherein a blade support arm having a socket is at one end of an elongated hollow member, and furthermore wherein an opposite open end is adapted to receive shaving cream with a cap adapted to retain the shaving cream, preferably in the form of pellets.

Druash et al., U.S. Pat. No. 4,377,034, describes a safety razor kit comprising a razor head assembly and a pressurized dispensing container of shaving cream or gel, wherein the contents of the container are dispensed through the head assembly. The assembly carries a horizontally mounted bracket for holding the cartridge razor when shaving and a vertically mounted bracket for holding the disposable cartridge at a vertical position along the side of the razor handle when the kit is not in use.

Gotto, U.S. Pat. No. 4,542,828, describes an implement comprising a toothbrush portion and a razor portion, the toothbrush portion being connected or connectable directly or indirectly to the razor.

In addition to these shaving devices, Walther et al., U.S. Pat. No. 4,408,920 describe a portable toothbrush device which includes a self-contained charge of dentifrice, stationary bristle head, and means for discharging the dentifrice, at the location of the toothbrush bristles.

It is an object of the present invention to provide a shaving device which is safe to store, convenient to operate and inexpensive to produce.

It is also an object of the present invention to provide a disposable shaving device which can be tidily and conveniently stored after one use and used a second time.

It is also an object of the present invention to provide a disposable shaving device which can be conveniently reloaded with shaving gel after the gel chamber is emptied.

SUMMARY OF THE INVENTION

The invention is a substantially cylindrical pocket razor having:

a substantially cylindrical body shaft having an upper portion and a lower portion, wherein the upper portion includes a slanted segment which is not parallel to the lower portion and front and back segments which are substantially parallel to the lower portion, the lower portion is substantially parallel to the shaft axis, the front segment of the shaft has a reduced diameter, the back segment has an interior chamber for containing shaving gel, and the slanted or front segment has one or more openings for removing the gel from the chamber;

a razor blade base pivotably or removably attached to the front segment of the body shaft with a connector, wherein the base has a razor blade;

a substantially cylindrical plunger communicating with the body shaft, the plunger having an upper portion and a lower portion, wherein the upper portion includes a slanted segment which is not parallel to the lower portion and front and back segments which are substantially parallel to the lower portion, the lower portion is substantially parallel to the plunger axis which is substantially parallel to the shaft axis, wherein a major portion of the plunger has a diameter smaller than the inside diameter of the shaft, and wherein the communication is such that the plunger is slidable within the shaft;

a substantially cylindrical plunger end cap having a closed end and an open end, the plunger cap having a diameter greater than either the plunger or the shaft, wherein the plunger cap interior surface communicates with the shaft outside surface and is capable of sliding along the shaft axis, and wherein plunger cap interior surface projections communicate with the plunger and transfer force, which is administered to the plunger cap in the direction of the shaft front segment, to the plunger; and a substantially cylindrical shaft end cap having a closed end and an open end, the shaft cap having a diameter greater than the shaft, wherein the shaft cap interior surface communicates with the shaft outside surface and is capable of sliding along the shaft axis.

The drawings show certain embodiments of the shaving device. They should not be interpreted as limiting the scope of the present invention.

DESCRIPTION OF PREFERRED EMBODIMENT

Figure 1:
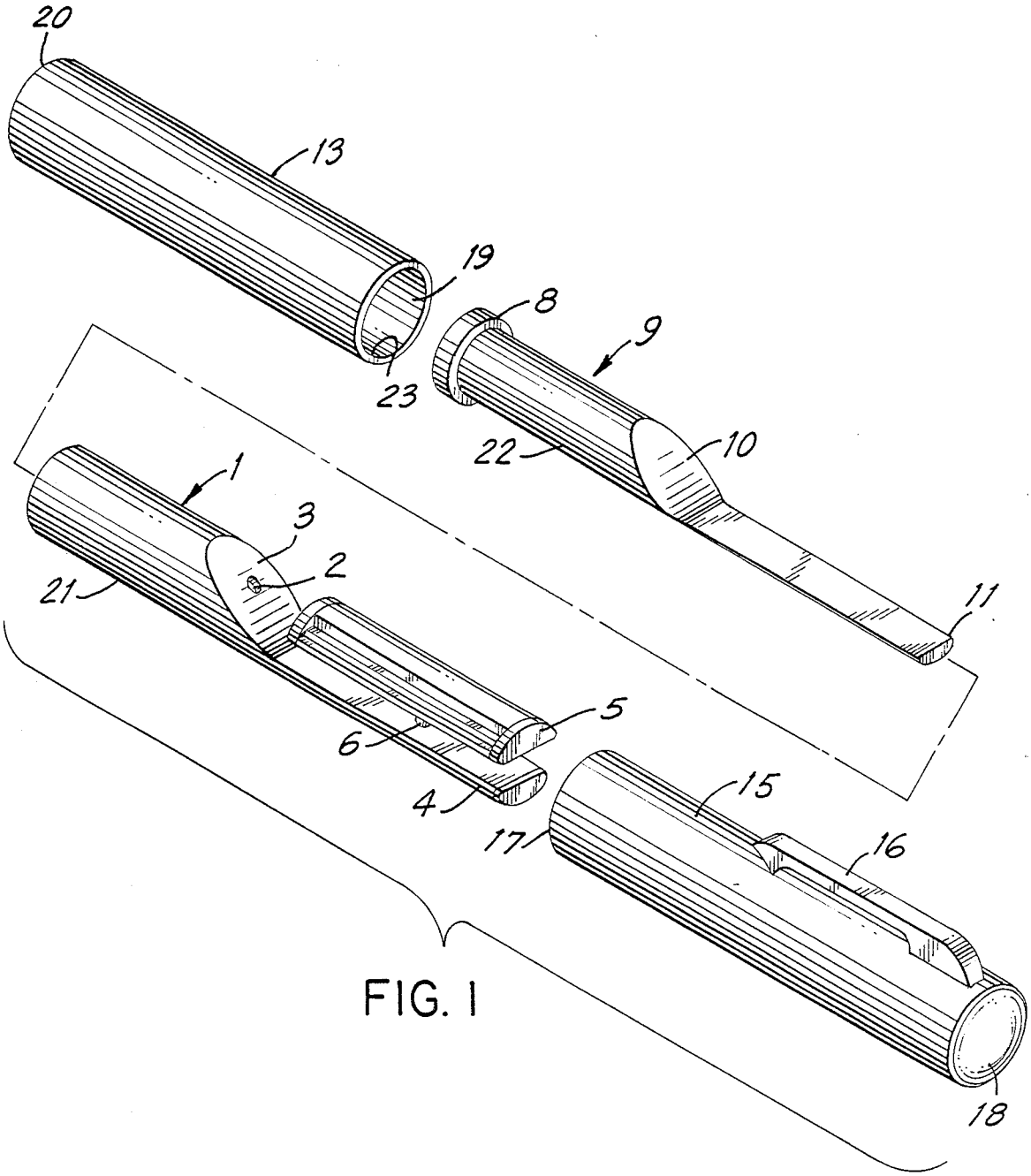
FIG. 1 is an exploded perspective view.

FIG. 1 is an exploded perspective view of one embodiment of the shaving device.

Razor blade base 5 communicates with connector 6, which is mounted to shaft 1 at shaft front segment 4.

Figure 3:
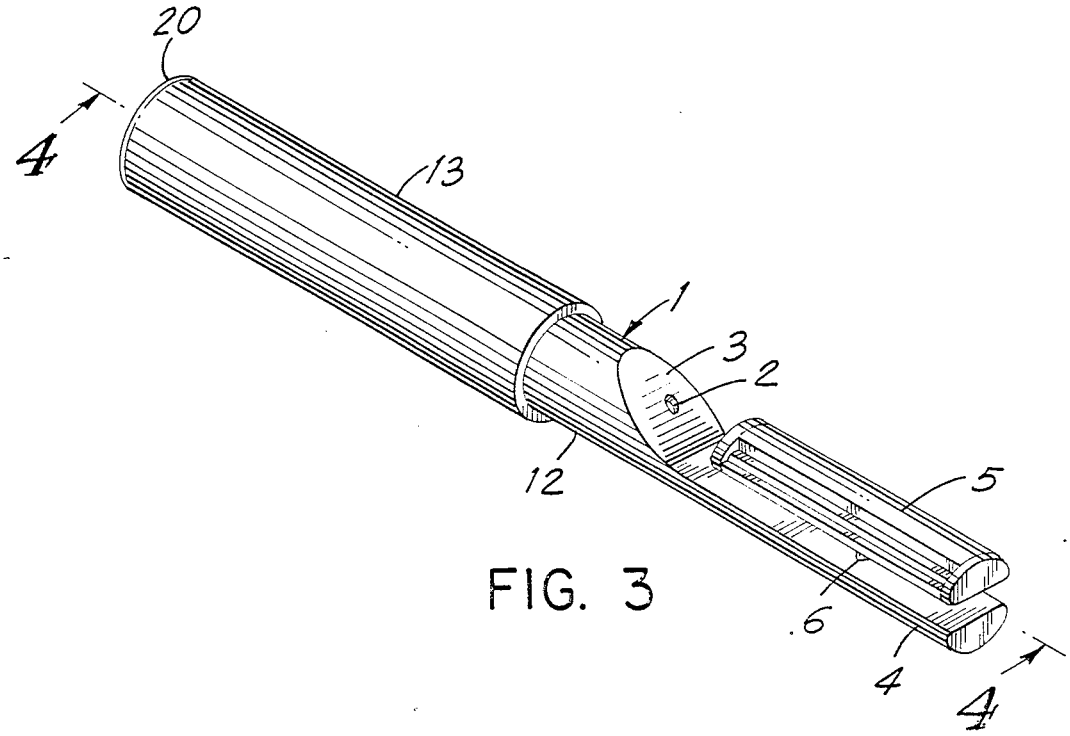
FIG. 3 is a perspective view of the invention with razor exposed.

Shaft 1 is substantially cylindrical in shape, having varying diameters at each segment. Shaft back segment 21 has a large diameter, shaft slanted segment 3 a gradually narrowing diameter from shaft back segment 21 end to shaft front segment 4 end, and shaft front segment 4 a narrow diameter. FIG. 3 shows a perspective view of one embodiment of the invention with razor exposed. Shaft front segment 4 may also be in the shape of a semi-cylinder having a curved side and an opposite flat side. Opening 2 is between connector 6 and shaft back segment 21, and communicates with shaving gel chamber 12. Preferably, opening 2 is located on shaft slanted segment 3.

Connector 6 may be a stationary mount onto which base 5 attaches in one or more positions suitable for either device storage or device use. The mount may for example be a bracket onto which base 5 couples. Alternatively, connector 6 may be a pivotable mechanism which allows the position of base 5 to swing from storage position to use position and back again.

Figure 4:
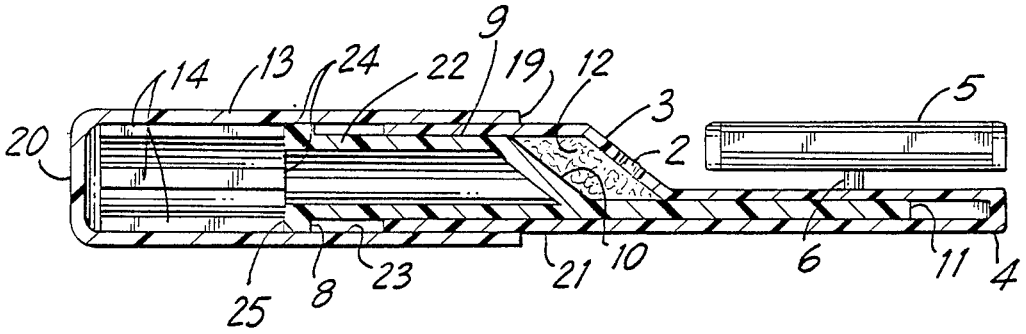
FIG. 4 is a sectional view through lines 4—4 of FIG. 3.
Figure 5:
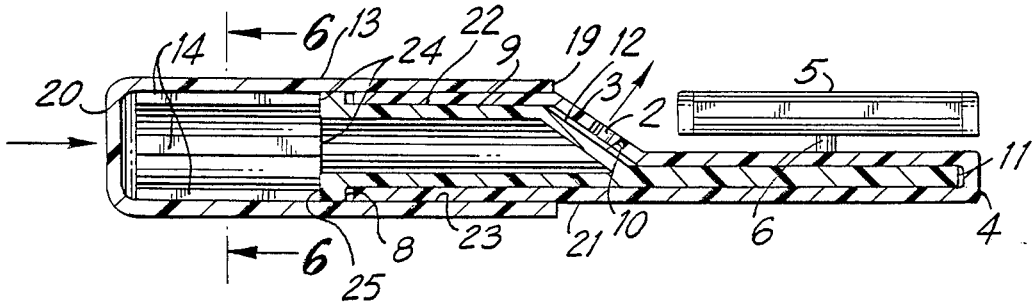
FIG. 5 is a view of FIG. 4 with plunger pushed to right.

FIG. 4 is a sectional view through lines 4—4 of FIG. 3, with plunger 9 in "pre-use" position. FIG. 5 is a sectional view through lines 4—4 of FIG. 3, with plunger 9 in "use" position.

FIGS. 4 and 5 provide sectional side view of shaft 1, razor base 5, connector 6 and plunger 9. Plunger 9 is slidable within shaft 1. Plunger front segment 11 diameter is narrower than shaft front segment 4, plunger slanted segment 10 diameter is narrower than shaft slanted segment 3 and plunger back segment 22 diameter is narrower than back segment 21. Plunger 9 has a plunger back end ring 8, the diameter of which substantially coincides with shaft 1 diameter such that ring 8 cannot slide within shaft 1. Plunger 9 is slidable in forward and backward directions, and operates to force shaving gel stored in shaving gel chamber 12 through opening 2 when pushed toward shaft front end 4. Plunger slanted segment 10 surface contacts shaving gel stored in chamber 12, and slidably operates such that as plunger 9 is pushed toward shaft front segment 4, chamber 12 diminishes in size and shaving gel exits through opening 2, and is safely and conveniently received by the device user. Location of the opening minimizes accidental contact of the user with razor blade.

FIGS. 4 and 5 also show plunger end cap 13 which has plunger end cap open end 19, plunger end cap closed end 20, and base cap interior surface projections 14. Cap 13 is of sufficient diameter to slide around shaft back segment 21 and plunger back end ring 8, and base cap interior surface projections 14 extend from plunger end cap interior surface 23 to a distance sufficient for base cap interior surface projection fronts 24 to contact plunger back end ring back surface 25 when plunger end cap 13 is pushed toward shaft front segment 4. As cap 13 slides toward front segment 4, plunger 9 also slides toward front segment 4.

Figure 6:
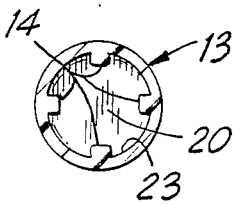
FIG. 6 is a sectional view through lines 6—6 of FIG. 5.

FIG. 6 shows a sectional view through lines 6—6 of FIG. 5, indicating one suitable arrangement of base cap interior surface projections 14 extending from plunger end cap interior surface 23.

Figure 2:
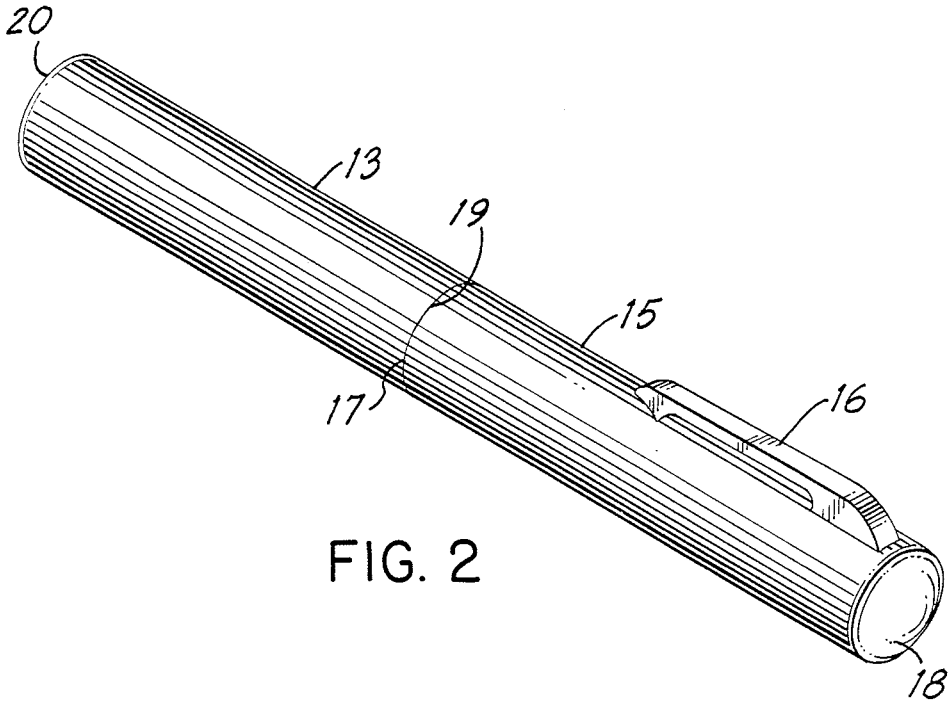
FIG. 2 is an assembled view of FIG. 1.

FIG. 2 shows a perspective view of one embodiment of the device with plunger end cap 13 facing shaft end cap 15, where plunger end cap open end 19 meets shaft end cap open end 17. Cap 15 is of sufficient diameter to enclose razor blade base 5 connected to shaft front segment 4 with connector 6, and to slide around shaft back segment 21. Clip 16, mounted to shaft end cap 15, conveniently holds the shaving device in the pocket of the user.

What is claimed is:

1. A substantially cylindrical pocket razor having:

a substantially cylindrical body shaft having an upper portion and a lower portion, wherein the upper portion includes a slanted segment which is not parallel to the lower portion and front and back segments which are substantially parallel to the lower portion, the lower portion is substantially parallel to the shaft axis, the front segment of the shaft has a reduced diameter, the back segment has an interior chamber for containing shaving gel, and the slanted or front segment has one or more openings for removing the gel from the chamber;

a razor blade base pivotably or removably attached to the front segment of the body shaft with a connector, the base having a razor blade;

a substantially cylindrical plunger communicating with the body shaft, the plunger having an upper portion and a lower portion, wherein the upper portion includes a slanted segment which is not parallel to the lower portion and front and back segments which are substantially parallel to the lower portion, the lower portion is substantially parallel to the plunger axis which is substantially parallel to the shaft axis, wherein a major portion of the plunger has a diameter smaller than the inside diameter of the shaft, and wherein the communication is such that the plunger is slidable within the shaft;

a substantially cylindrical plunger end cap having a closed end and an open end, the plunger cap having a diameter greater than either the plunger or the shaft, wherein the plunger cap interior surface communicates with the shaft outside surface and is capable of sliding along the shaft axis, and wherein plunger cap interior surface projections communicate with the plunger and transfer force which is administered to the plunger cap in the direction of the shaft front segment, to the plunger; and a substantially cylindrical shaft end cap having a closed end and an open end, the shaft cap having a diameter greater than the shaft, wherein the shaft cap interior surface communicates with the shaft outside surface and is capable of sliding along the shaft axis.

2. A razor according to claim 1 wherein the razor blade base is coupled to a bracket which is mounted to the shaft front segment, such that the razor blade base may be selectively positioned in a position substantially parallel to the shaft axis, or in a position substantially perpendicular to the shaft axis.

3. A razor according to claim 1 wherein the razor blade base is pivotably connected to the shaft front segment and may be selectively positioned in a position substantially parallel to the shaft axis, or in a position substantially perpendicular to the shaft axis.

* * * * *